US007052307B2

(12) United States Patent
Kim et al.

(10) Patent No.: US 7,052,307 B2
(45) Date of Patent: May 30, 2006

(54) MODULAR JACK HAVING CONNECTING CAP

(75) Inventors: Jung Gon Kim, Siheung-si (KR); Jung Suk Lee, Ansan-si (KR); Hye Jung Kim, Anyang-si (KR)

(73) Assignee: Dae Eun Electronics Co., Ltd., Anyany-si (KR)

( * ) Notice: Subject to any disclaimer, the term of this patent is extended or adjusted under 35 U.S.C. 154(b) by 0 days.

(21) Appl. No.: 10/770,720

(22) Filed: Feb. 3, 2004

(65) Prior Publication Data

US 2005/0170682 A1 Aug. 4, 2005

(51) Int. Cl.
*H01R 11/20* (2006.01)
*H01R 4/26* (2006.01)
*H01R 4/24* (2006.01)

(52) U.S. Cl. ..... 439/404; 439/676

(58) Field of Classification Search ..... 439/404, 439/405, 417, 676, 387, 389, 391, 395
See application file for complete search history.

(56) References Cited

U.S. PATENT DOCUMENTS 6,238,231 B1 * 5/2001 Chapman et al. ..... 439/404
RE38,519 E * 5/2004 Doorhy et al. ..... 439/404

* cited by examiner

*Primary Examiner*—Javaid H. Nasri
(74) *Attorney, Agent, or Firm*—Volpe And Koenig, P.C.

(57) ABSTRACT

The present invention discloses a modular jack for connecting a modular plug, and more particularly, a modular jack with a connection cap which comprises: a plurality of IDC terminals electrically connected to a printed circuit board; a back cover provided with a plurality of penetration grooves so as to support the IDC terminals; and a connection cap for pressurizing and connecting wires to connection slits of the IDC terminals penetrated through penetration grooves of the back covers and protruded outward, the connection cap being provided with terminal insertion grooves for inserting the plurality of IDC terminals and a plurality of wire insertion grooves for coupling wires, the back cover and the connection cap being detachably coupled to a housing. Thus, by inserting wires of a communication line to the wire insertion grooves of the connection cap and then making them close to the rear side of the back cover and coupling them thereto, the wires can be connected to the IDC terminals without any particular working tool.

3 Claims, 10 Drawing Sheets

<PRIOR ART>

<PRIOR ART>

<PRIOR ART>

MODULAR JACK HAVING CONNECTING CAP

BACKGROUND OF THE INVENTION

1. Field of the Invention

The present invention relates to a modular jack which is connected to a modular plug of a terminal device, and more particularly, to a modular plug with a connection cap which is capable of connecting a wire of a communication line to an IDC terminal of a modular jack without any particular working tool.

2. Description of the Related Art

Generally, in order to establish a communication by using a terminal device (computer and telephone) capable of data and voice communication, the terminal device should be connected to an incoming communication line. For this, a modular plug is prepared at the terminal device and a modular jack is provided at the end of the incoming communication line.

FIG. 1 is an explosive perspective view showing one example of a modular jack according to the conventional art. As shown therein, the conventional modular jack mainly comprises a housing 100 and a connecting body 900 coupled to the rear surface of the housing 100. The housing 100 has a plug insertion port 110 formed on the front surface for inserting a modular plug 800 and a connecting body coupling portion 150 formed on the opposite side for inserting a connecting body 900. The connecting body 900 includes an insert 200 electrically connected to the modular plug 800, an IDC type terminal block 600 with a plurality of IDC terminals mounted thereto and a printed circuit board 300 on which the insert 200 and the IDC type terminal bock 600 are electrically connected and fixed. Further, a connection block 700 for pressurizing a wire is provided at the rear of the IDC type terminal block 600. Accordingly, when the wire of the communication line is connected to the IDC type terminal block 600, it is electrically connected with the modular plug 800 through an IDC terminal, a pattern of the printed circuit board 300 and the terminal of the insert 200 to thereby enable communication.

Meanwhile, FIG. 2 is an explosive perspective view showing another example of a modular jack according to the conventional art. The modular jack includes an IDC type terminal block 600 with a plurality of IDC terminals 400 mounted thereto and a connection block 700 coupled to the upper side of the IDC type terminal block 600. Further, the IDC type terminal block 600 is formed with IDC terminal insertion grooves 610 facing each other and having a predetermined angle and a plurality of wire insertion grooves 620 orthogonal to the IDC terminal insertion grooves 610. The connection block 700 is coupled to the upper side of the IDC type terminal block 600 and has a rib 710 formed on the lower part and surface-contacted to both opposite side faces of the upper part of the IDC type terminal block 600 for pressurizing the wire.

Therefore, when the wire W of the communication line is connected to the IDC type terminal block 600, firstly, a plurality of wires W are all inserted into the entrance side of the wire insertion grooves 620 formed on the upper end of the IDC type terminal block 600, and then the connection block 700 is coupled to the upper part of the IDC type terminal block 600, to thereby making the rib 710 of the connection block 700 pressurize downward the wires W coming out to both sides of the IDC type terminal block 600. Then, as the downwardly pressurized wires W are stripped off by cutters formed on the connection slits of the IDC terminals 400, they are coupled and electrically connected to the IDC terminals 400.

In this way, the conventional modular jack employs a method of inserting a wire to the IDC type terminal block 600, thus the modular jack with the IDC type terminal block 600 fixed thereto has to be in a free state so as to enable a wire connection work. For example, in the case that a plurality of modular jacks are coupled to a patch panel or an outlet plate or the like, a wire has to be connected only after each of the modular jacks is separated from the patch panel. Thus, it was very difficult to connect a wire to a patch panel or the like that has a plurality of modular jacks closely coupled thereto.

In recent times, however, various kinds of terminal devices are used by simultaneous connection, thus the use of patch panels with a plurality of modular jacks coupled thereto are growing larger and larger. Accordingly, there was a demand for a modular jack of a new type which is capable of performing a wire connection work with ease without separating the modular jack coupled to such patch panel.

SUMMARY OF THE INVENTION

The present invention is designed in consideration of the problems of the prior art, and therefore it is an object of the present invention to provide a modular jack with an IDC terminal connection cap which is capable of easily connecting a wire with hands without using any particular working tool, conveniently connecting a wire even when coupled to a patch panel or the like, and preventing foreign materials from coming into an IDC terminal.

To achieve the above object, there is provided a modular jack according to the present invention, comprising: a back cover which is detachably coupled to the rear surface of a housing for receiving a modular plug and provided with a plurality of penetration grooves through which a plurality of IDC terminals are penetrated; and a connection cap which is detachably coupled to the rear surface of the back cover and provided with terminal insertion grooves for inserting the plurality of IDC terminals protruded by penetrating the penetration grooves and a plurality of wire insertion grooves for inserting wires of a communication line, the terminal insertion grooves and the wire insertion grooves orthogonal to each other.

Furthermore, the back cover comprises: two penetration groove blocks which is provided with a plurality of penetration grooves through which the IDC terminals fixed in two lateral rows on the rear surface of the printed circuit board; a back cover main body which is integrally formed to support the two penetration groove blocks; coupling hooks which are protruded forward on both opposite side faces of the back cover main body and detachably coupled to the housing; and guide plates which are protruded rearward on the upper and lower surfaces of the back cover main body and provided on the inner side surface with guide grooves for guiding the connection cap.

Furthermore, the connection cap comprises: a plurality of terminal insertion grooves for inserting the upper end portions of the IDC terminals protruded to the rear side of the penetration groove blocks; two connection blocks which are provided with a plurality of wire insertion grooves formed orthogonal to the terminal insertion grooves so that the wires of the communication line can be inserted into the connection slits of the IDC terminals; a connection cap main body which is integrally formed so as to support the two connection blocks; guide projection which are formed on the upper and lower surfaces of the connection cap main body and guided by guide grooves formed on the guide plates of the back cover; and detachable hooks which are integrally formed to the guide projections and detachably coupled to the back cover.

Furthermore, the IDC terminals fixed to the printed circuit board are fixed zigzag so that the distance between the terminals becomes longer, and the penetration grooves of the penetration groove blocks and the terminal insertion grooves of the connection block are formed zigzag so as to correspond to the IDC terminals.

Accordingly, when wires of a communication line are connected to the modular jack according to the present invention, a plurality of wires are all inserted into the entrance sides of the wire insertion grooves formed on the connection cap, and then pressurized so as to be coupled to the rear surface of the back cover of the modular jack connected to a patch panel or outlet plate. Then, as the IDC terminals protruded to the rear side of the back cover are inserted into the terminal insertion grooves formed on the connection cap, the wires are stripped off by cutters of the IDC terminals and electrically connected to the connection slots of the IDC terminals.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
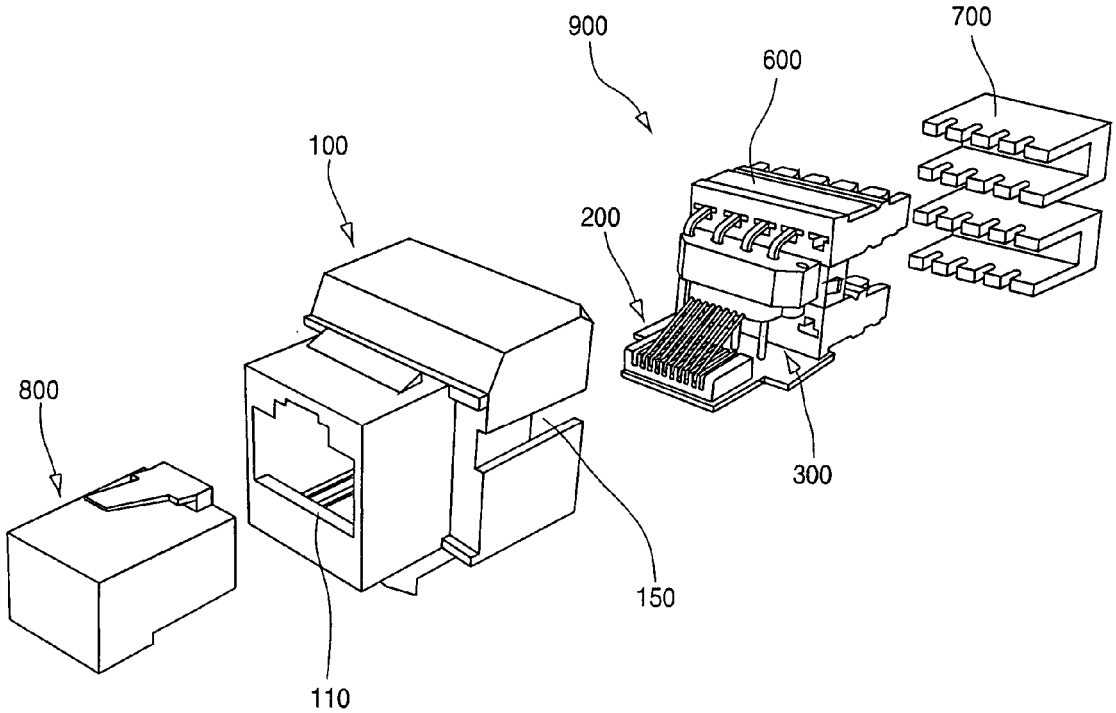
FIG. 1 is an explosive perspective view showing one example of a modular jack according to the conventional art.
Figure 2:
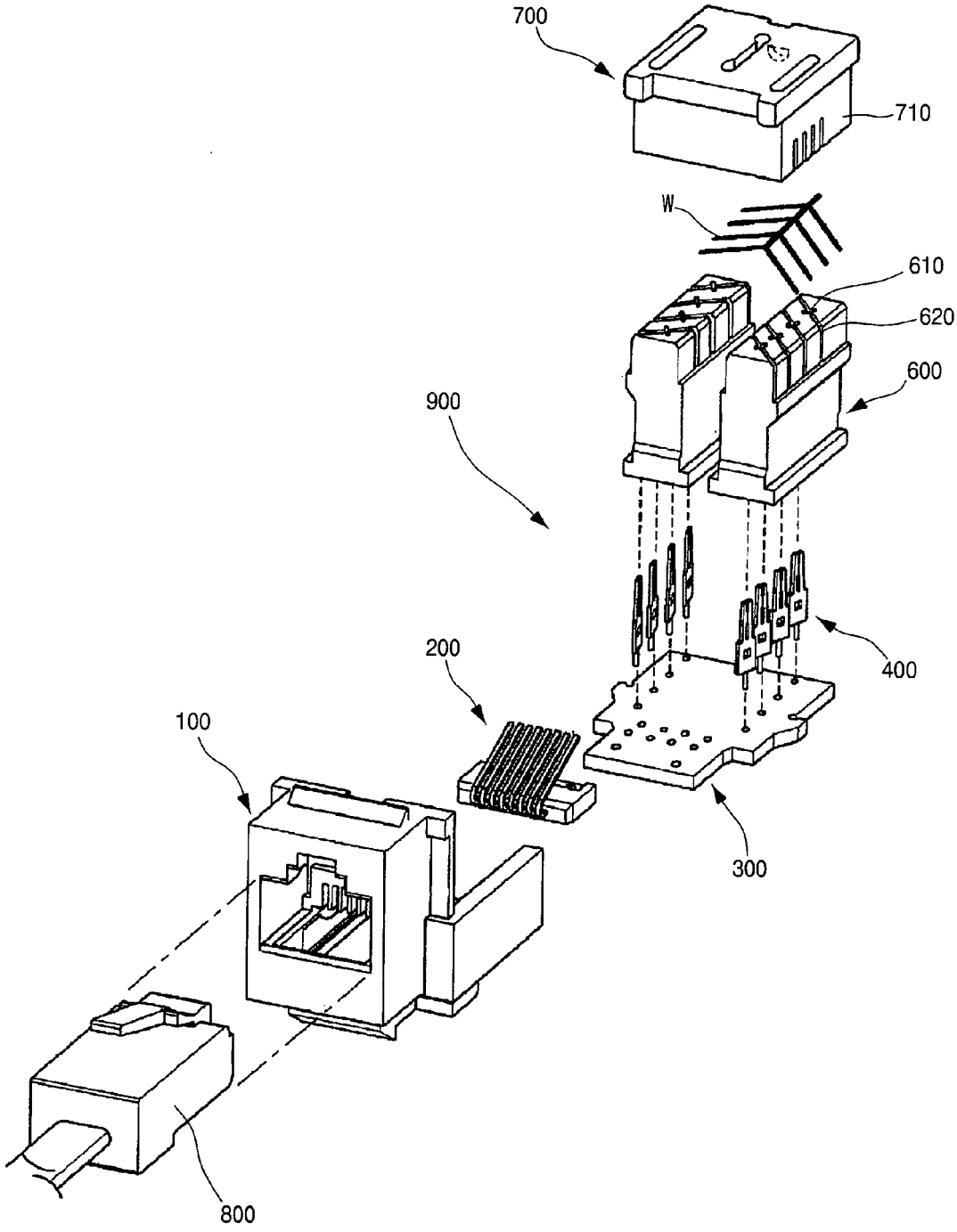
FIG. 2 is an explosive perspective view showing another example of a modular jack according to the conventional art.
Figure 3:
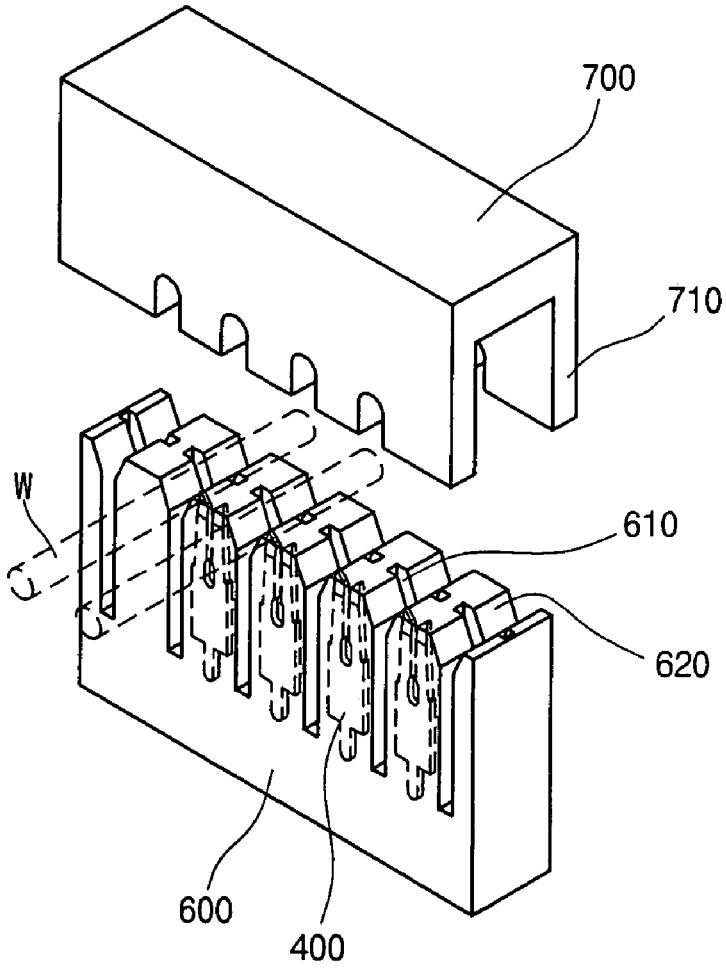
FIG. 3 is a conceptual view schematically showing an IDC terminal block which is adapted to a modular jack according to the conventional art.

Hereinafter, a modular jack of the present invention will be described in more detail referring to the drawings.

Figure 4:
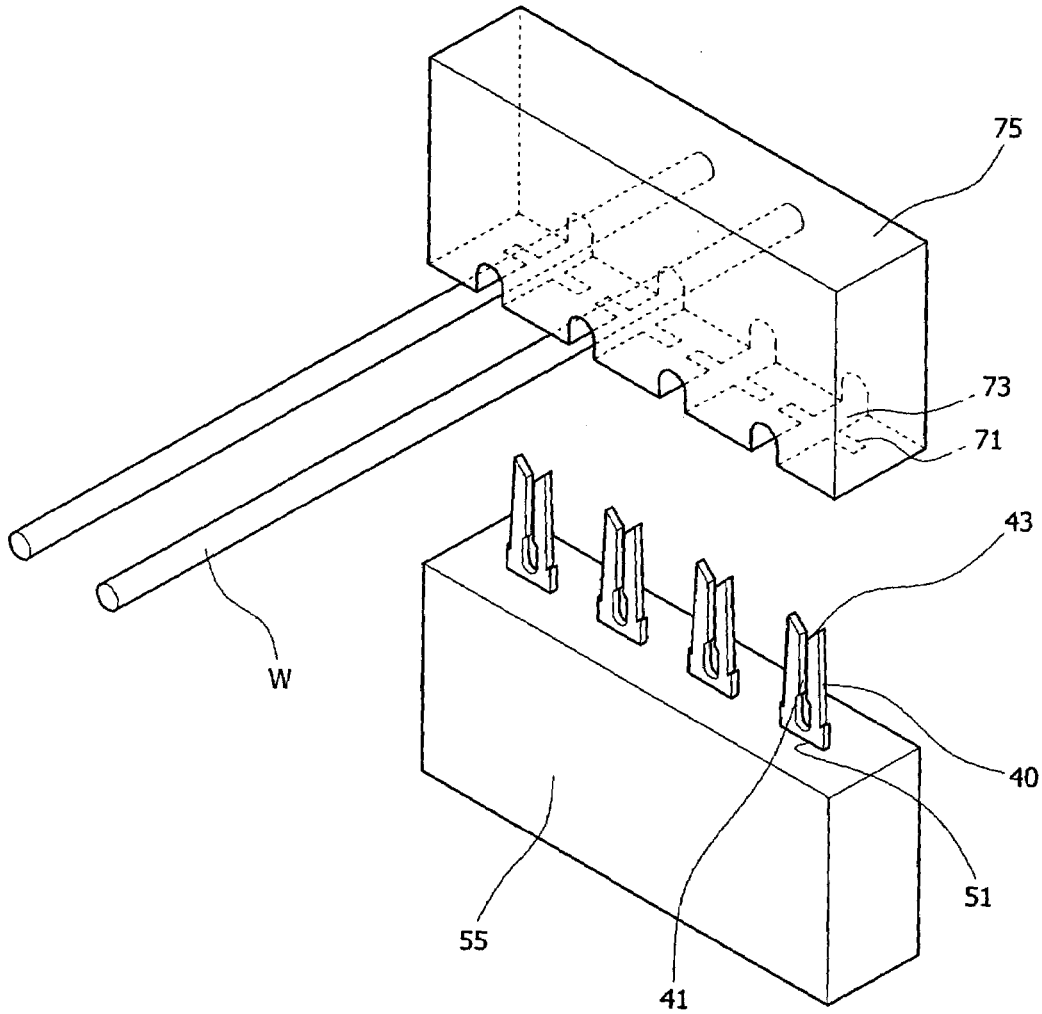
FIG. 4 is a conceptual view schematically showing a penetration groove block and a connection block which are adapted to a modular jack according to the present invention.

Firstly, FIG. 4 is a conceptual view schematically showing a penetration groove block and a connection block which are adapted to a modular jack according to the present invention. As shown therein, reference numeral 55 is a penetration groove block with a plurality of penetration grooves 51 which a plurality of IDC terminals 40 are penetrated through, and reference numeral 75 is a connection block with terminal insertion grooves 71 which a plurality of IDC terminals 40 are inserted into and wire insertion grooves 73 which wires W are inserted into.

Accordingly, when it is desired to connect wires W to the IDC terminals 40 protruded to the penetration groove block 55, firstly, every wire is inserted into the entrance side of the wire insertion grooves 73 formed on the connection block 75, and then pressurized so that the IDC terminals 40 are inserted into the terminal insertion grooves 71 of the connection block 75. Then, as the wires W are inserted into connection slots 41 of the IDC terminals, they are stripped off by cutters 43 formed on the upper end thereof and electrically connected.

In this way, the method of inserting wires into connection block 75 and connecting them into IDC terminals 40 of a penetration groove block 55 can carry out a connection work even in a state that the modular jack (penetration groove block) is not moved in comparison with the conventional method of inserting wires into IDC terminal blocks 600 and then inserting a connection block 700 to connect the wires. Thus, the wiring work is made much easier.

Figure 5:
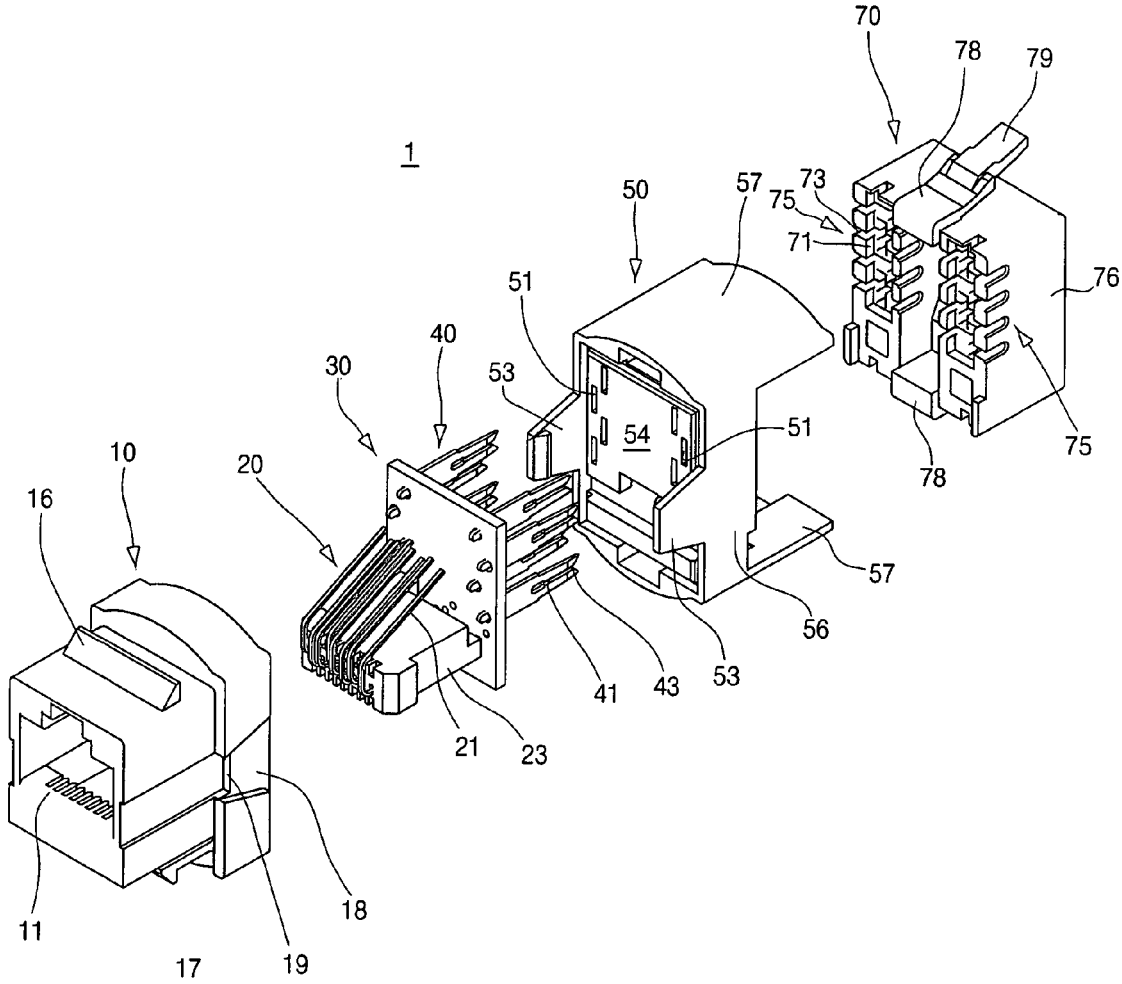
FIG. 5 is an explosive perspective view of a modular jack when viewed from a front surface according to the present invention.
Figure 6:
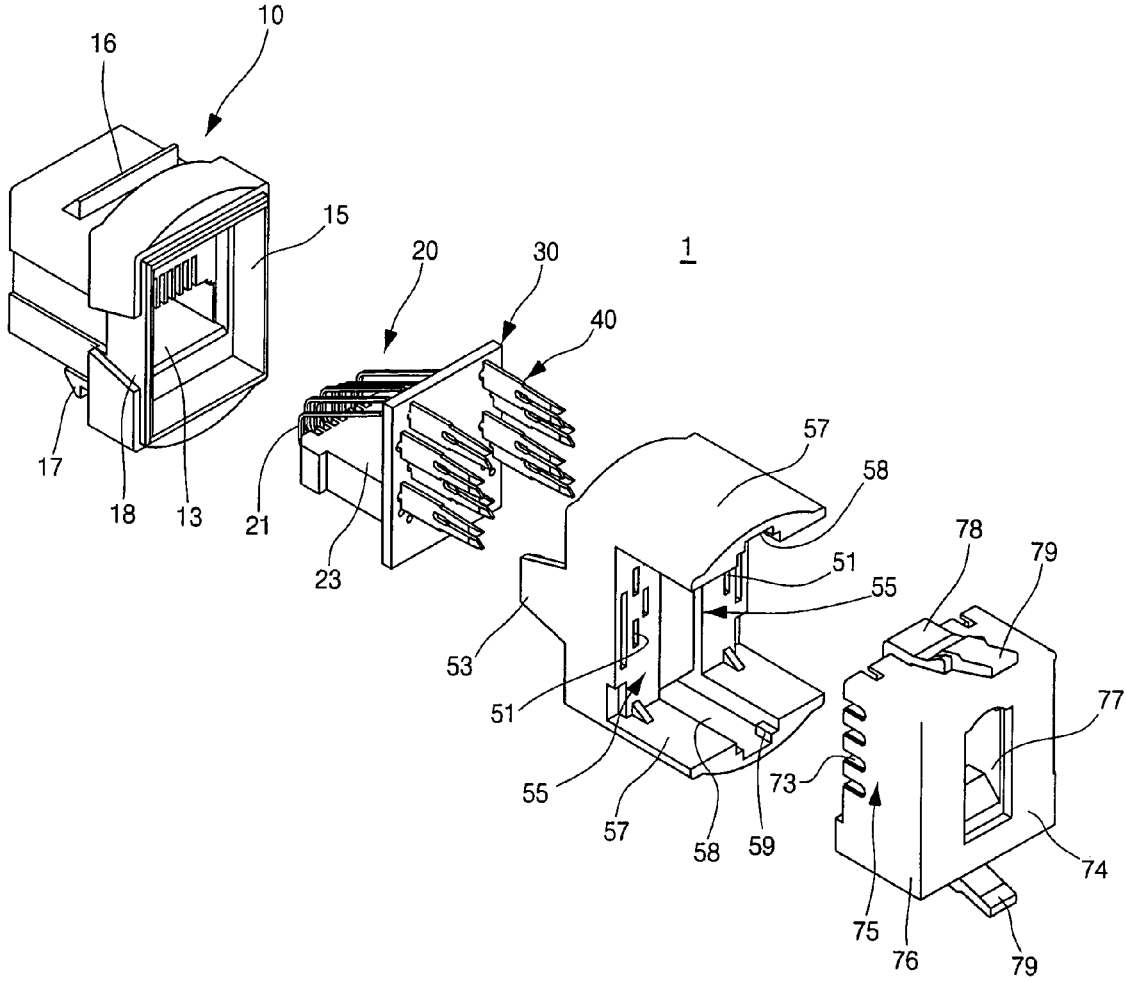
FIG. 6 is an explosive perspective view of a modular jack when viewed from a rear surface according to the present invention.
Figure 7:
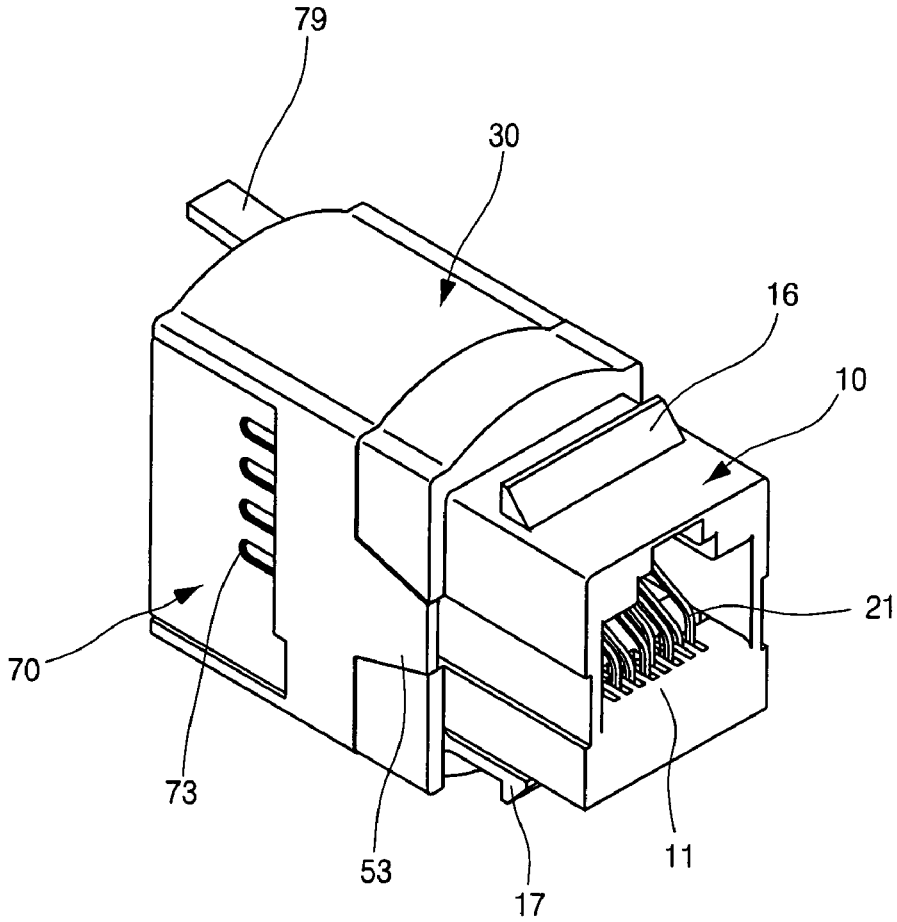
FIG. 7 is an assembly perspective view of the modular jack according to the present invention.

Hereinafter, a preferred embodiment of a modular jack with an IDC terminal connection cap according to the present invention will be described in detail with reference to the accompanying drawings. Firstly, FIGS. 5 and 6 are explosive perspective views of a modular jack according to this embodiment. FIG. 5 is a view when viewed from a front surface and FIG. 6 is a view when viewed from a rear surface. FIG. 7 is an assembly perspective view of the modular jack.

As shown therein, the modular jack 1 comprises: a housing 10 which is provided with a plug insertion port 11 formed on the front surface; an insert 20 which is coupled to a coupler formed on the rear surface of the housing 10; a printed circuit board 30 which is electrically connected to the insert 20 and mounted perpendicular to the rear surface of the housing 10; a plurality of IDC terminals 40 which are electrically connected and fixed to the rear surface of the housing 10; a back cover 50 which is detachably coupled to the rear surface of the housing 10 and provided with a plurality of penetration grooves 51 through which the IDC terminals 40 are penetrated; and a connection cap 70 which is detachably coupled to the rear surface of the back cover 50 and formed in a manner that terminal insertion grooves 71 for inserting the plurality of IDC terminals 40 protruded rearward through the IDC terminal penetration grooves 51 and a plurality of wire insertion grooves 73 for coupling wires are orthogonal to each other.

The above description will be described more concretely with reference to FIG. 6. The housing 10 has a plug insertion port 11 formed on the front surface, and the plug insertion port 11 has an insert coupler 13 formed on the opposite side of the plug insertion port 11 and for coupling the insert 20 and a printed circuit board mounting portion 15 formed on the rear surface and for mounting a printed circuit board 30 at an angle. Further, a stopping protuberance 16 and an elastic hook 17 detachably coupled to a path panel or outlet plate are formed on the upper and lower surfaces of the housing 10. In addition, guide grooves 18 and stopping ridges 19 for detachably coupling to coupling hooks 53 of the back cover 50 are formed on both opposite side faces of the housing 10.

The insert 20 includes eight terminal 21 arranged in two rows and an insert body 23 surrounding these terminals. The terminals 21 at the front end are arranged to be connectable to the terminal of a modular plug 80 that is inserted into the plug insertion port 11 of the housing 10, and the terminals 21 at the rear end are electrically connected and fixed to the printed circuit board 30.

The printed circuit board 30 is mounted perpendicular to the printed circuit board mounting portion 15 formed on the rear surface of the housing 10, and has the insert 20 fixed to the front surface thereof and the IDC terminals 40 in two lateral rows fixed zigzag to the rear surface thereof. Further, the terminals of the insert 20 and the IDC terminals 40 are electrically connected via a PCB pattern (not shown). At this time, the PCB pattern contains capacitance and inductance to reduce cross talk generated from the modular jack. Thus, the IDC terminals 40 are electrically connected to the modular plug 80 inserted into the plug insertion port 11 through the PCB pattern of the printed circuit board and the terminals 21 of the insert 20. Meanwhile, the IDC terminals 40 are formed with connection slots 41 and have cutters 43 formed on the front ends for being able to strip wires.

Continuously, the back cover 50 is formed with two penetration groove block 55 with a plurality of IDC terminal penetration grooves 51 through which the IDC terminals 40 are penetrated and supported. The penetration groove blocks 55 are integrally formed on both lateral sides of a front wall 54 contacted to the rear surface of the housing 10 to constitute a back cover main body 56. On both opposite sides of the back cover main body 56, integrally formed are cantilever coupling hooks 53 capable of coupling to the guide grooves 18 and the stopping ridges 19 formed on both opposite sides of the housing 10. On the upper and lower surface of the back cover main body 56, integrally protruded are guide plates 57 for guiding and coupling the connection cap 70. On the inner side faces of the guide plates 57, formed are guide grooves 58 for guiding the connection cap 70 and a stopping ridge 59 for coupling to detachable hooks 79 of the connection cap 70.

The connection cap 70 includes, as shown in FIG. 5, two connection blocks 75 formed in a manner that a plurality of terminal insertion grooves 71 and a plurality of wire insertion grooves 73 are orthogonal to each other. The two connection blocks 75 are integrally formed at the left and right of a rear wall 74 with a cable insertion port 77 at the center, to thereby form a connection cap main body 76. On the upper and lower surface of the connection cap main body 76, formed are guide projections 78 guided by the guide grooves 58 of the back cover 50 and the detachable hooks 79 for detachably coupling to the stopping ridge 59 formed on the rear ends of the guide plates 57.

Therefore, the IDC terminals 40 fixed to the printed circuit board 30 are penetratingly coupled to the plurality of penetration grooves 51, and then the connection cap 70 is coupled so as to insert the upper end portions of the IDC terminals 40 exposed to the rear side of the penetration groove blocks 55, to thereby assemble the modular jack 1 according to the present invention.

Figure 8:
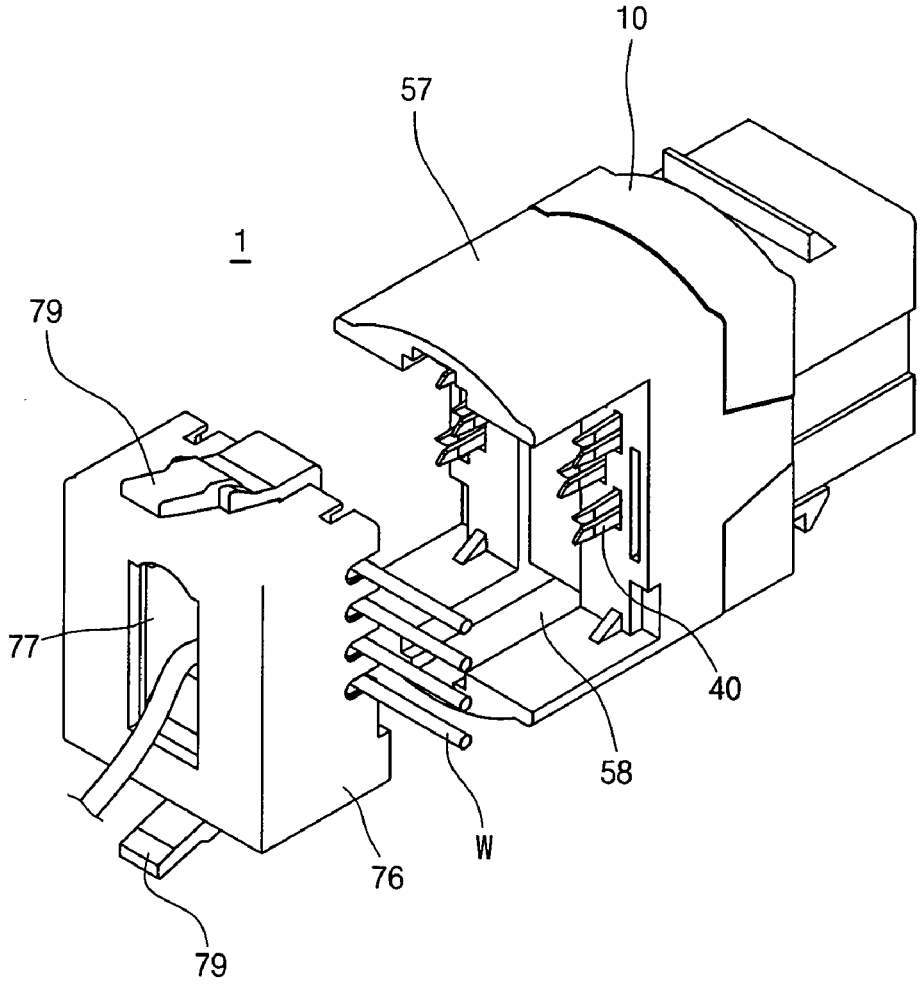
FIG. 8 is a perspective view showing a procedure of connecting wires of a communication line to the modular jack according to the present invention.
Figure 9:
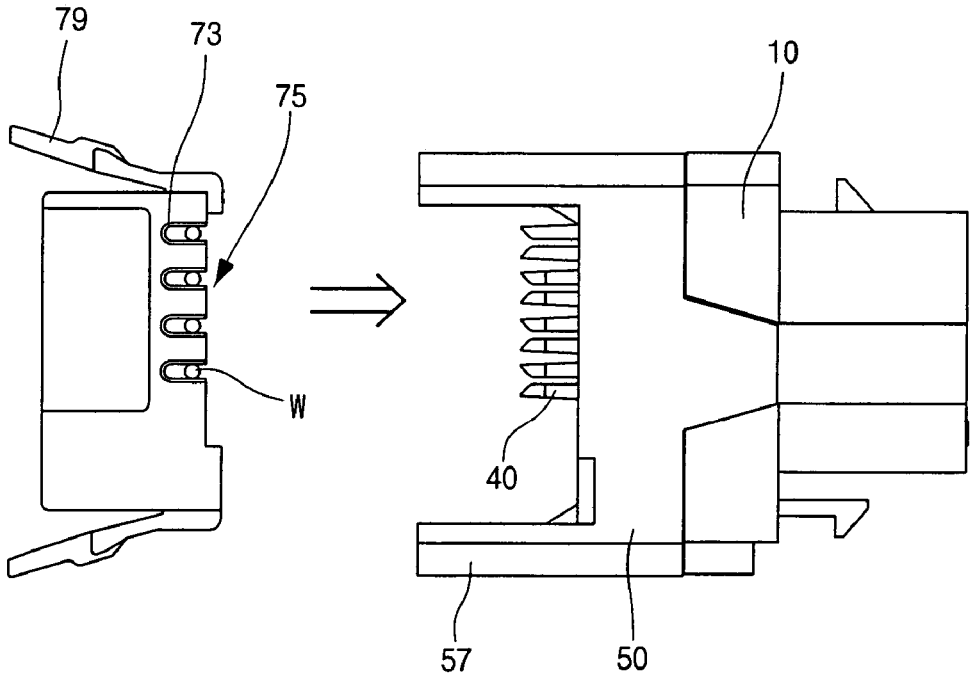
FIG. 9 is a side view showing a procedure of connecting wires of a communication line to the modular jack according to the present invention.
Figure 10:
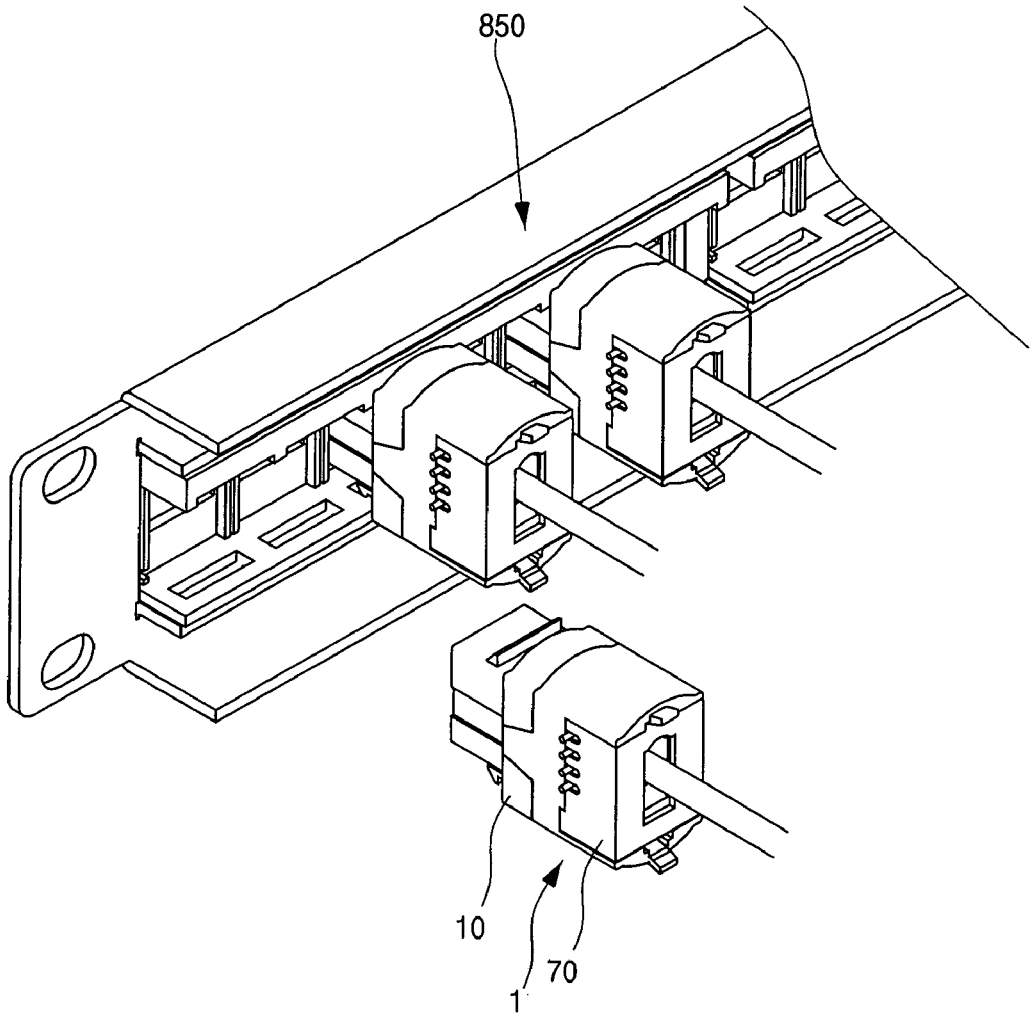
FIG. 10 is a perspective view a procedure of connecting a modular jack to a patch panel according to the present invention.

Hereinafter, a procedure of connecting wires of a communication line to the modular jack according to the present invention will be explained with reference to FIGS. 8 and 9. As shown therein, in order to connect wires of a communication line to the modular jack 1, firstly, the connection cap 70 of the modular jack 1 is separated from the back cover 50, then a cable is inserted via a cable insertion port 77 of the connection cap 70, and then a plurality of wires W are sequentially inserted into the entrance side of the wire insertion grooves 73 of the connection cap 70. Next, the connection cap 70 gets near to the rear side of the back cover 50 and coupled thereto. Then, as the IDC terminals 40 exposed to the rear side of the back cover 50 are inserted into the terminal insertion grooves 71 of the connection cap 70, the wire are stripped off by the cutters 43 and electrically connected to the connection slits 41. Accordingly, the wires W are electrically connected to the modular plug 80 that is inserted into to the housing 10 through the IDC terminals 40, the pattern of the printed circuit board 30 and the terminals of the insert 20. Continuously, the wires W laterally protruded are cut out and smoothed, and then, as shown in FIG. 10, a plurality of modular jacks 1 are disposed in one row to the couplers of a patch panel 850. In this way, the modular jack 1 according to the present invention has the connection cap 70 integrally disposed to the housing 10. Thus, if necessary, even after the disposition, the modular jack 1 can be substituted or moved with ease.

As seen from above, the modular jack of the present invention can carry out a wire connection work without any particular working tool and enables a jack movement even after being coupled to a patch panel because the connection cap is integrally coupled to the housing.

Furthermore, the modular jack according to the present invention has no risk of loss and prevents foreign materials, such as dust or the like, from being introduced to the IDC terminals since the connection cap is detachably coupled to the back cover.

What is claimed is:

1. A modular jack with a connection cap, comprising:

a housing which receives a modular plug to a front surface of the housing and couples an insert and a printed circuit board to a rear surface of the housing;

a back cover which is detachably coupled to the rear surface of the housing and provided with a plurality of penetration grooves through which IDC terminals fixed to the printed circuit board are penetrated;

a connection cap which is detachably coupled to the rear surface of the back cover and provided with terminal insertion grooves for inserting the plurality of IDC terminals protruded by penetrating the penetration grooves and a plurality of wire insertion grooves for inserting wires of a communication line, the terminal insertion grooves and the wire insertion grooves are orthogonal to each other;

wherein the back cover comprises two penetration groove blocks which are provided with the plurality of penetration grooves through which IDC terminals fixed in two lateral rows on the rear surface of printed circuit board;

a back cover main body which is integrally formed to support the two penetration groove blocks;

coupling hooks which are protruded forward on both opposite side faces of the back cover main body and detachably coupled to the housing; and guide plates which are protruded rearward on the upper and lower surfaces of the back cover main body and provided on the inner side surface with guide grooves for guiding the connection cap.

2. A modular jack with a connection cap comprising:

a housing which receives a modular plug to a front surface of the housing and couples an insert and a printed circuit board to a rear surface of the housing;

a back cover which is detachably coupled to the rear surface of the housing and provided with a plurality of penetration grooves through which IDC terminals fixed to the printed circuit board are penetrated a connection cap which is detachably coupled to the rear surface of the back cover and provided with terminal insertion grooves for inserting the plurality of IDC terminals protruded by penetrating the penetration grooves and a plurality of wire insertion grooves for inserting wires of a communication line, the terminal insertion grooves and the wire insertion grooves are orthogonal to each other;

wherein the connection cap comprises the plurality of terminal insertion grooves for inserting the upper end portions of IDC terminals protruded to the rear side of the penetration groove blocks;

two connection blocks which are provided with the plurality of wire insertion grooves formed orthogonal to the terminal insertion grooves so that the wires of a communication line can be inserted into connection slits of the IDC terminals;

a connection cap main body which is integrally formed at the left and right side of a rear wall so as to support the two connection blocks;

guide projections which are formed on the upper and lower surfaces of the connection cap main body and guided by guide grooves formed on guide plates of the back cover; and detachable hooks which are integrally formed to the guide projections and detachably coupled to the back cover.

3. A modular jack, comprising:

a housing which is provided with a plug insertion port formed on the front surface;

an insert which is coupled to a coupler formed on the rear surface of the housing;

a printed circuit board which is electrically connected to the insert and mounted to the rear surface of the housing;

a plurality of IDC terminals which are electrically connected and fixed to the rear surface of the printed circuit board;

a back cover which is detachably coupled to the rear surface of the housing and provided with a plurality of penetration grooves through which the IDC terminals are penetrated;

wherein the back cover includes two penetration groove blocks which are provided with the plurality of penetration grooves through which IDC terminals fixed in two lateral rows on a rear surface of printed circuit board, and a back cover main body which is integrally formed to support said two penetration groove blocks, and coupling hooks which are protruded forward on both opposite side faces of the back cover main body and detachably coupled to the housing, and guide elates which are protruded rearward on the upper and lower surfaces of the back cover main body and provided on the inner side surface with guide grooves for guiding a connection cap; and the connection cap which is detachably coupled to the rear surface of the back cover and provided with terminal insertion grooves for inserting the plurality of IDC terminals protruded rearward through the IDC terminal penetration grooves and a plurality of wire insertion grooves for inserting wires, the terminal insertion grooves and the wire insertion grooves being orthogonal to each other;

wherein the connection cap include the plurality of terminal insertion grooves for inserting the upper end portions of IDC terminals protruded to the rear side of the penetration groove blocks, and two connection blocks which are provided with the plurality of wire insertion grooves formed orthogonal to the terminal insertion grooves so that the wires of a communication line can be inserted into connection slits of the IDC terminals, and a connection cap main body which is integrally formed at the left and right side of a rear wall so as to support the two connection blocks, and guide projection which are formed on the upper and lower surfaces of the connection cap main body and guided by said guide grooves formed on guide plates of the back cover, and detachable hooks which are integrally formed to the guide projections and detachably coupled to the back cover.

* * * * *